US007036228B2

(12) United States Patent
Chen

(10) Patent No.: US 7,036,228 B2
(45) Date of Patent: May 2, 2006

(54) MULTIFUNCTIONAL KNIFE DEVICE

(76) Inventor: Jiunn-Liang Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/216,474

(22) Filed: Aug. 6, 2002

(65) Prior Publication Data

US 2004/0025353 A1 Feb. 12, 2004

(51) Int. Cl.
*B26B 11/00* (2006.01)

(52) U.S. Cl. ..... 30/122; 30/146; 30/254; 30/262; 30/289; 30/293

(58) Field of Classification Search ..... 30/122, 30/123, 131, 132, 133, 134, 142, 146, 135, 30/244, 254, 261, 262, 286, 289, 293; 7/167, 7/168, 129–135; D8/55, 57
See application file for complete search history.

(56) References Cited

U.S. PATENT DOCUMENTS 78,002 A * 5/1868 Myers ..... 30/286
276,793 A * 5/1883 Erdman et al. ..... 7/128
1,630,871 A * 5/1927 Tasker ..... 30/286
1,638,883 A * 8/1927 Schulz ..... 30/286
2,338,007 A * 12/1943 Morris ..... 30/351
4,046,148 A * 9/1977 Meador ..... 606/28
D276,975 S * 1/1985 Wordtmann ..... D8/57
D337,248 S * 7/1993 Tanfoglio ..... D8/57
5,255,438 A * 10/1993 Morgan ..... 30/254
6,671,967 B1 * 1/2004 Huang ..... 30/254 X
6,698,099 B1 * 3/2004 Ronan et al. ..... 30/122

* cited by examiner

*Primary Examiner*—Clark F. Dexter
(74) *Attorney, Agent, or Firm*—Alan D. Kamrath; Nikolai & Mersereau, P.A.

(57) ABSTRACT

A multifunctional knife device has a main handle, a main blade having a tang inserted in the main handle, an auxiliary handle, an auxiliary blade having a serrated tang inserted in the auxiliary handle, and a spring inserted in the main handle and the auxiliary handle. The main blade has a plurality of round holes, and the tang having a round aperture. The auxiliary blade has a circular aperture. A pivot bolt fastens the main blade and the auxiliary blade together. A nut engages with the pivot bolt. The main handle has a slot. A serrated block is inserted in the slot of the main handle. The auxiliary handle has a notch to match the slot of the main handle.

4 Claims, 5 Drawing Sheets

MULTIFUNCTIONAL KNIFE DEVICE

BACKGROUND OF THE INVENTION

The present invention relates to a knife device. More particularly, the present invention relates to a multifunctional knife device which is specially used for a diving exercise.

Referring to FIGS. 1 and 2, a conventional multi-functional knife device has a main handle 20', a main blade 10' disposed on the main handle 20', an auxiliary handle 22', an auxiliary blade 220' disposed on the auxiliary handle 22', and a fluorescent tube 40' inserted in the main handle 20'. The main blade 10' has a round aperture 30', a back 12', and a true edge 120' having a plurality of serrations 11'. The auxiliary blade 220' has a circular aperture 301'. A pivot button 31' passes through the round aperture 30' of the main blade 10' and the circular aperture 301' of the auxiliary blade 220' to fasten the main blade 10' and the auxiliary blade 220' together. The auxiliary handle 22' has a notch 23'. The main handle 20' has a through aperture 200' to receive an elastic element 25', a channel 21' to receive the fluorescent tube 40', a groove 24' to match the notch 23' of the auxiliary handle 22', and a click block 240' inserted in the groove 24'. The auxiliary handle 22' engages with the main handle 20'.

SUMMARY OF THE INVENTION

An object of the present invention is to provide a multifunctional knife device which can be operated easily.

Another object of the present invention is to provide a multifunctional knife device which can cut a metal article.

Accordingly, a multifunctional knife device comprises a main handle, a main blade having a tang inserted in the main handle, an auxiliary handle, an auxiliary blade having a serrated tang inserted in the auxiliary handle, and a spring inserted in the main handle and the auxiliary handle. The main blade further has a back, a tip end, at least one round hole, and the tang having a round aperture. The auxiliary blade further has a circular aperture. A pivot bolt passes through the round aperture of the main blade and the circular aperture of the auxiliary blade to fasten the main blade and the auxiliary blade together. A nut engages with the pivot bolt. The main handle has a slot. A serrated block is inserted in the slot of the main handle. The auxiliary handle has a notch to match the slot of the main handle.

DETAILED DESCRIPTION OF THE INVENTION

Figure 1:
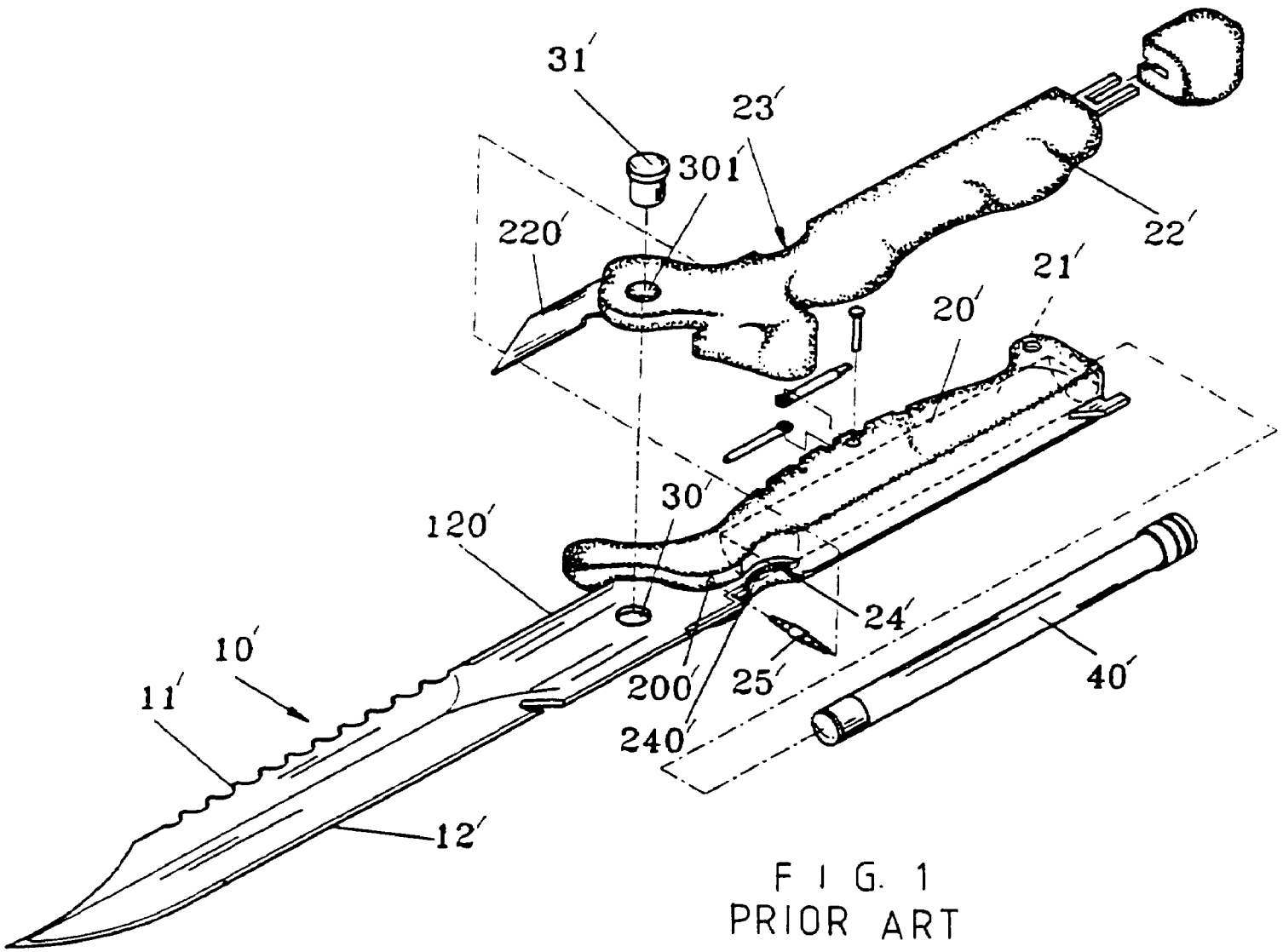
FIG. 1 PRIOR ART
FIG. 1 is a perspective exploded view of a conventional multifunctional knife device of the prior art.
Figure 2:
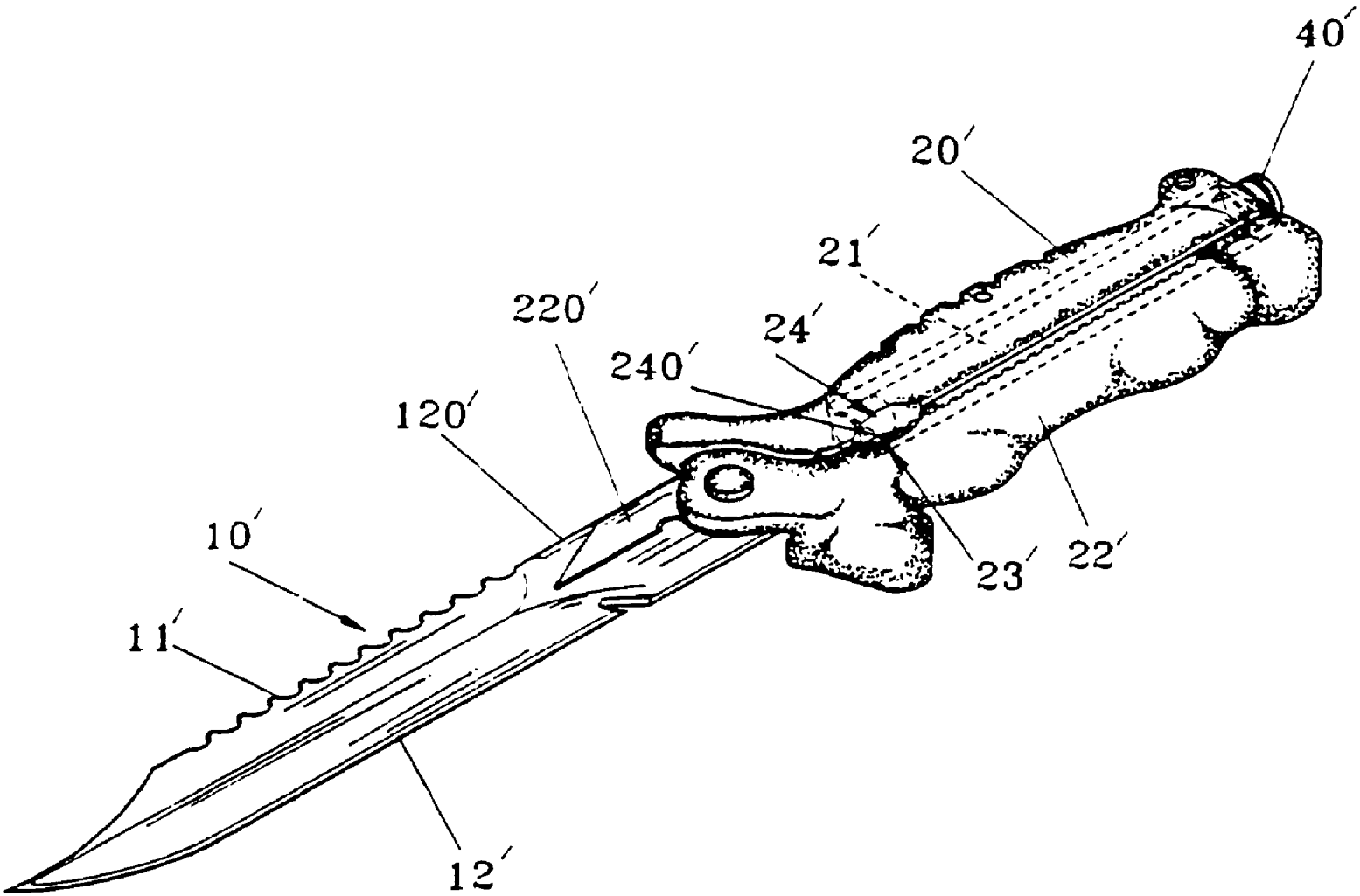
FIG. 2 PRIOR ART
FIG. 2 is a perspective assembly view of a conventional multifunctional knife device of the prior art.
Figure 3:
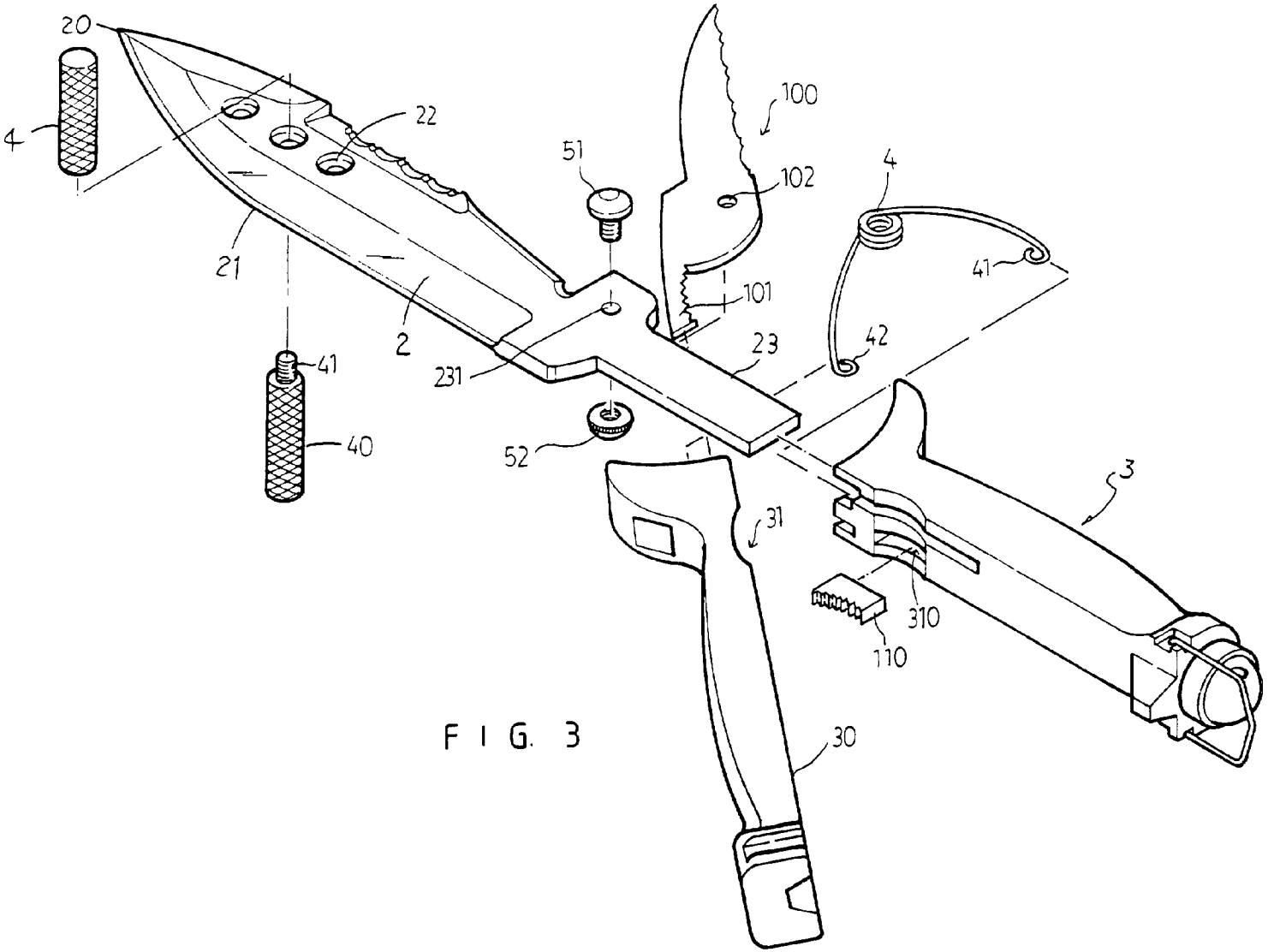
FIG. 3 is a perspective exploded view of a multi-functional knife device of a preferred embodiment in accordance with the present invention.
Figure 4:
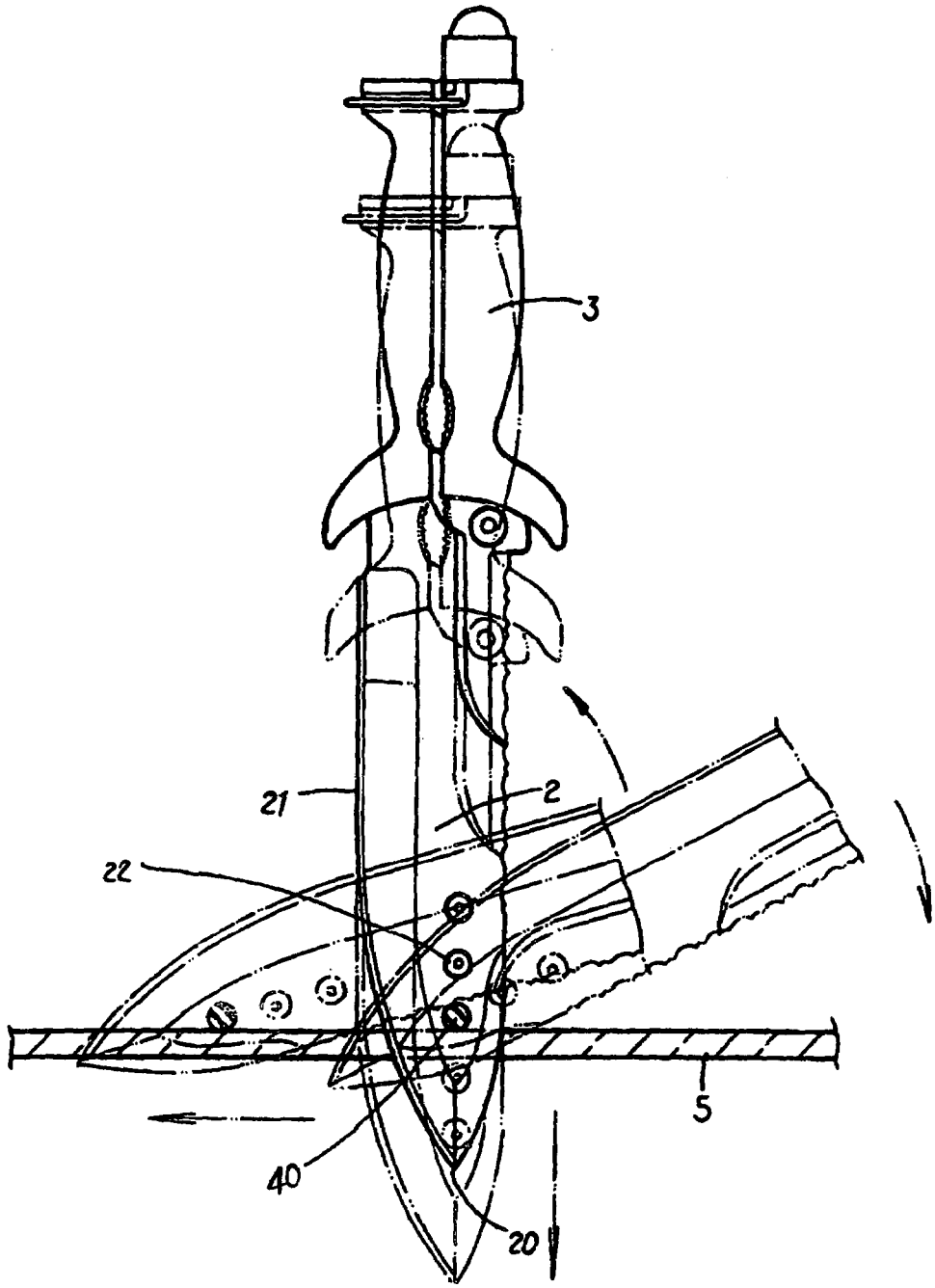
FIG. 4 is a schematic view illustrating an application of a multifunctional knife device of a preferred embodiment in accordance with the present invention.
Figure 5:
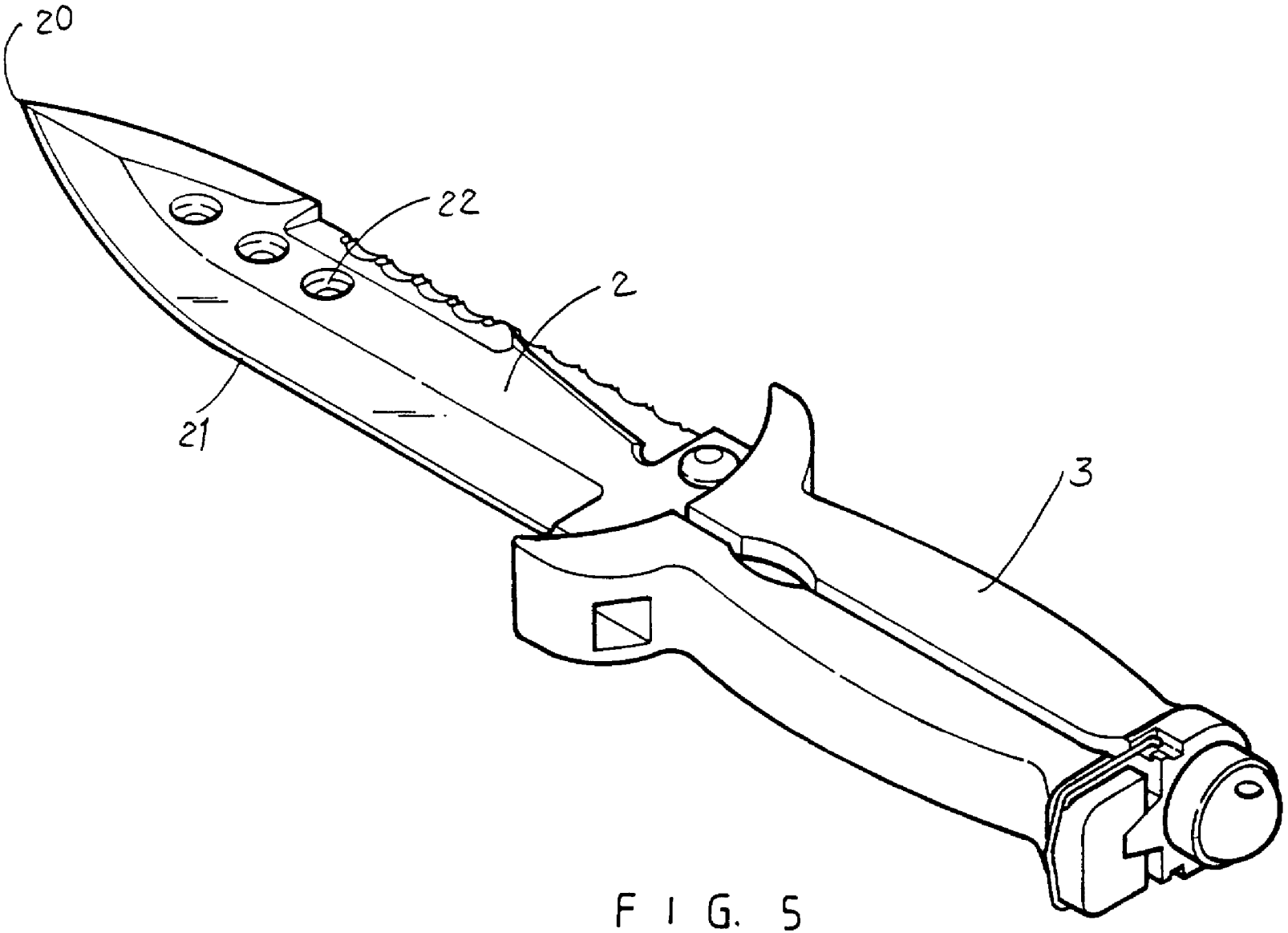
FIG. 5 is a perspective assembly view of a multi-functional knife device of a preferred embodiment in accordance with the present invention.

Referring to FIGS. 3 to 5, a multifunctional knife device comprises a main handle 3, a main blade 2 having a tang 23 inserted in the main handle 3, an auxiliary handle 30, an auxiliary blade 100 having a serrated tang 101 inserted in the auxiliary handle 30, and a spring 4 inserted in the main handle 3 and the auxiliary handle 30.

The main blade 2 has a back 21, a tip end 20, a plurality of round holes 22, and the tang 23 having a round aperture 231.

The auxiliary blade 100 has a circular aperture 102.

A pivot bolt 51 passes through the round aperture 231 of the main blade 2 and the circular aperture 102 of the auxiliary blade 100 to fasten the main blade 2 and the auxiliary blade 100 together.

A nut 52 engages with the pivot bolt 51.

The main handle 3 has a slot 310.

A serrated block 110 is inserted in the slot 310 of the main handle 3.

The auxiliary handle 30 has a notch 31 to match the slot 310 of the main handle 3.

The spring 4 has a first end 4A inserted in the main handle 3 and a second end 4B inserted in the auxiliary handle 30.

An insertion pin 40 is inserted in one of the round holes 22 of the main blade 2.

A sleeve 42 engages with the insertion pin 40 and the insertion pin 40 has a threaded post 41 threadedly inserted in the sleeve 42.

Referring to FIG. 4 again, the insertion pin 40 is disposed on a metal plate 5. Therefore, the main blade 2 can cut the metal plate 5 gradually.

When a user dives in a sea, the multifunctional knife device of the present invention will cut a net while the user is entrapped by the net.

An article can be put between the slot of the main handle and the notch of the auxiliary handle in order to be rotated by the multifunctional knife device of the present invention.

The present invention is not limited to the above embodiment but various modification thereof may be made. Furthermore, various changes in form and detail may be made without departing from the scope of the present invention.

I claim:

1. A multifunctional knife device comprises:

a main handle, a main blade having a tang inserted in the main handle, an auxiliary handle, an auxiliary blade having a serrated tang inserted in the auxiliary handle, a spring inserted in the main handle and the auxiliary handle, the main blade further having a back end, a tip end opposite the back end, and a plurality of round holes, wherein the tang is at the back end and has a round aperture, the auxiliary blade further having a circular aperture, a pivot bolt passing through the round aperture of the main blade and the circular aperture of the auxiliary blade to fasten the main blade and the auxiliary blade together, a nut engaging with the pivot bolt, the main handle having a slot, a serrated block inserted in the slot of the main handle, and the auxiliary handle having a notch to match the slot of the main handle, wherein the round holes of the main blade are located between the tip end and the tang of the main blade;

the multifunctional knife device further comprises an insertion pin inserted into one of the round holes of the main blade and having a threaded post protruding from the respective round hole, and a threaded sleeve removably screwed onto the threaded post of the insertion pin and rested on the main blade;

the insertion pin is secured on the main blade to function as a support of the main blade;

when the tip end of the main blade penetrates a workpiece, the insertion pin is rested on a surface of the workpiece to function as a fulcrum of the back end of the main blade, so that the back end of the main blade is pivoted about the insertion pin to cut the workpiece by a leverage action of the main blade.

2. The multifunctional knife device as claimed in claim 1, wherein the spring has a first end inserted into the main handle and a second end inserted into the auxiliary handle.

3. The multifunctional knife device as claimed in claim 1, wherein the round holes of the main blade are arranged in line with the tip end of the main blade.

4. The multifunctional knife device as claimed in claim 1, wherein the insertion pin is selectively inserted into and locked in any one of the round holes of the main blade to adjust a torque of the back of the main blade.

* * * * *